US007156287B2

(12) United States Patent
Heise

(10) Patent No.: US 7,156,287 B2
(45) Date of Patent: Jan. 2, 2007

(54) CONTAINER WITH INTEGRATED SPOUT AND METHOD FOR MAKING SAME

(75) Inventor: John Heise, Federal Way, WA (US)

(73) Assignee: Alliance Packaging, LLC, Renton, WA (US)

( * ) Notice: Subject to any disclaimer, the term of this patent is extended or adjusted under 35 U.S.C. 154(b) by 93 days.

(21) Appl. No.: 10/924,529

(22) Filed: Aug. 23, 2004

(65) Prior Publication Data

US 2005/0156021 A1 Jul. 21, 2005

Related U.S. Application Data

(60) Provisional application No. 60/536,904, filed on Jan. 16, 2004.

(51) Int. Cl.
*B65D 5/74* (2006.01)
*B65D 5/02* (2006.01)

(52) U.S. Cl. ..... 229/215; 229/221; 493/59

(58) Field of Classification Search ..... 229/214, 229/215, 217, 219, 221; 493/59–62, 87, 493/160, 161
See application file for complete search history.

(56) References Cited

U.S. PATENT DOCUMENTS 1,539,985 A * 6/1925 Allen ..... 229/215
1,907,939 A * 5/1933 Venning et al. ..... 229/215
2,358,659 A * 9/1944 Ringler ..... 229/215
5,316,212 A * 5/1994 Eriksson et al. ..... 229/215
5,372,301 A * 12/1994 Besson ..... 229/215
5,660,324 A * 8/1997 Rowland ..... 229/215
5,680,986 A * 10/1997 Botterman ..... 229/215
5,816,486 A * 10/1998 Wein ..... 229/215

OTHER PUBLICATIONS

Jefferson Smurfit Corporation (U.S.), proposed spout design, from at least as early as Oct. 31, 2003.

* cited by examiner

*Primary Examiner*—Gary E. Elkins
(74) *Attorney, Agent, or Firm*—Seed Intellectual Property Law Group PLLC

(57) ABSTRACT

The present invention provides a container with an integrated spout and a method for forming the container. The container includes an inner panel that defines a spout and an outer panel that defines an orifice. The width of the spout exceeds the width of the orifice. The outer panel may include a first tab adjacent to the orifice to provide access to the spout. The outer panel may also include a second tab that temporarily occludes the orifice. The orifice may be exposed when the spout on the inner panel is accessed and the second tab is at least partially detached by extracting the spout. An integrated spout on the inner panel, the width of which exceeds the width of the orifice on the outer panel, reduces the cycle time and cost of manufacturing containers with a spout and prevents the container contents from bypassing the spout upon pouring.

7 Claims, 10 Drawing Sheets

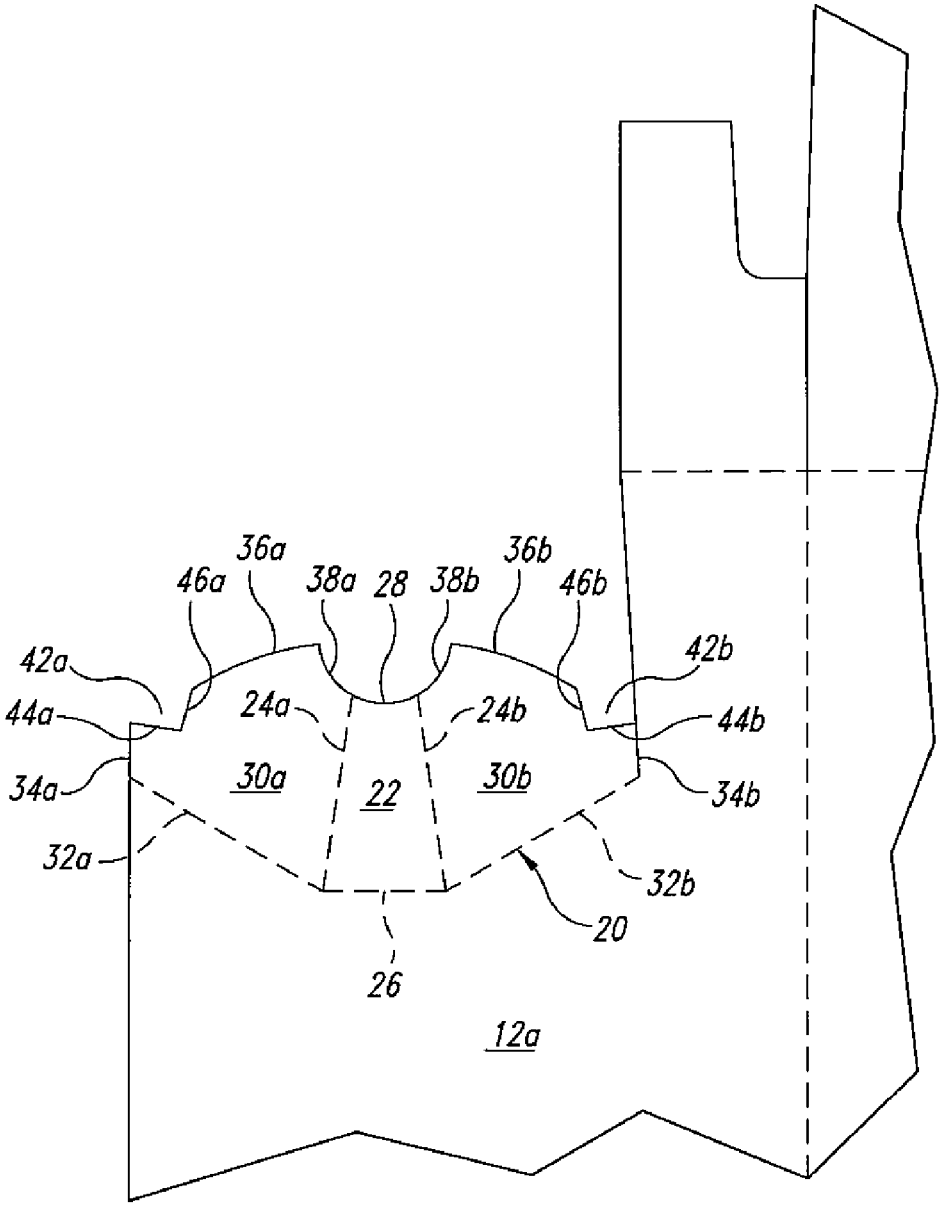
FIG. 3
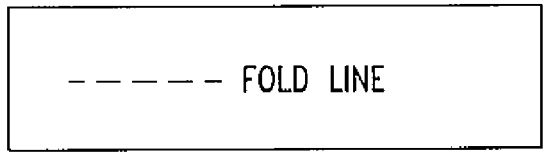

- - - - - - FOLD LINE

- - - - - - FOLD LINE

CONTAINER WITH INTEGRATED SPOUT AND METHOD FOR MAKING SAME

CROSS-REFERENCE TO RELATED APPLICATION

This application claims the benefit of U.S. Provisional Patent Application No. 60/536,904 filed Jan. 16, 2004, where this provisional application is incorporated herein by reference in its entirety.

BACKGROUND OF THE INVENTION

1. Field of the Invention

The present invention relates to containers, and more specifically, containers with pour spouts.

2. Description of the Related Art

Heretofore prior art solids dispensing pour spouts for containers used stamped steel or injection molded plastic spouts that required special box manufacturing steps. Attempts to create an integrated spout container, i.e., one that formed the spout from the container material, provided a solution to the excess manufacturing steps but resulted in a spout that undesirably permitted dispensed solids to bypass the spout. Thus, a need arose to provide an integrated spout solution that minimized the solids bypass problem of the prior art.

BRIEF SUMMARY OF THE INVENTION

The invention provides for an integrated solids dispensing pour spout for use in solids dispensing containers and methods for fabricating a container having the same. The invention comprises a first panel defining a spout and a second panel defining an orifice. During use of the invention, the first panel is overlapped by the second panel to permit a portion of the spout to emerge from the orifice upon application of a bias force to the spout. In a container application, the first panel is defined as an inner panel and the second panel is defined as an outer panel. The lateral centerline of the spout is aligned with the lateral centerline of the orifice and further positioned so that the spout may emerge through the orifice upon application of a tension force to the spout.

As previously described, the first panel defines the spout. The spout remains contiguous with the first panel at a lower hinge segment; otherwise, it is separate or separable from the first panel. The spout comprises a central portion from which first and second lateral wings hingedly extend. Each lateral wing has a perimeter edge comprising a lower edge segment (which may include a lateral edge segment) and an upper edge segment. The central portion may be discrete or may be characterized as the area of intersection between the first and second lateral wings. A maximum spout width is identified as "$SW_{max}$", and represents the maximum distance from the first wing edge to the second wing edge prior to deployment of the spout.

Also as previously described, the second panel defines an orifice. The orifice has a lower perimeter edge segment generally corresponding in length to the lower hinge segment of the spout. Lateral and upper perimeter edge segments complete the definition of the orifice, where the lateral perimeter edge segments are generally rectilinear and preferably converge towards the lower edge segment. The lateral perimeter edge segments also define a maximum orifice width, "$OW_{max}$", which is less than "$SW_{max}$". As will be described in more detail below, this feature causes the hinged first and second wings to fold towards the central portion when the spout is pivotally extended through the orifice.

Operation of the invention requires that the first and second panels be overlapped so that the lower hinge of the spout is generally congruent with the lower edge segment of the orifice. As an upper portion of the spout is caused to emerge from the orifice, the first and second wings are caused to fold by the partial obstruction provided by the orifice lateral perimeter edge segments, i.e., "$OW_{max}$" is less than "$SW_{max}$". Because of the compound angles involved and the regular surface of the wings, there is a high degree of latitude for selection of the orifice angle (the angle formed between the orifice lateral perimeter edge and centerline) and the spout angle (the angle formed between the lateral hinge and the centerline). Thus, a "wide" spout and a "narrow" spout can be used with the same orifice geometry, or vice versa. The degree of spout extension through the orifice is only limited by the depth of the wings (wing depth is defined as the arc length of the wing to orifice edge contact area as determined from the lower hinge thereof) and/or any over-extension prevention feature as described below.

A feature of the invention is the interaction between the first and second panels when establishing a spout. By forming a notch in each wing's upper edge segments, and ensuring that the length of each wing's lower edge segment is generally equal to or greater than the length of each lateral perimeter edge segment, over-extension of the spout can be prevented by the interference between the spout notches and upper perimeter edge segments of the orifice. Note that selective positioning of the first panel relative to the second panel can create such over-rotation interference even though the length of the wing's lower edge segment may be less than that of the orifice lateral perimeter edge segment. Thus, functional interference between the spout and the orifice overrides dimensional limitations in some circumstances.

BRIEF DESCRIPTION OF THE DRAWINGS

FIG. 3 is an enlarged view of the spout portion of the first embodiment shown in FIG. 2;

DETAILED DESCRIPTION OF THE INVENTION

The following discussion is presented to enable a person skilled in the art to make and use the invention. Various modifications to the preferred embodiment will be readily apparent to those skilled in the art, and the generic principles herein may be applied to other embodiments and applications without departing from the spirit and scope of the present invention as defined by the appended claims. Thus, the present invention is not intended to be limited to the embodiment shown, but is to be accorded the widest scope consistent with the principles and features disclosed herein.

Figure 1:
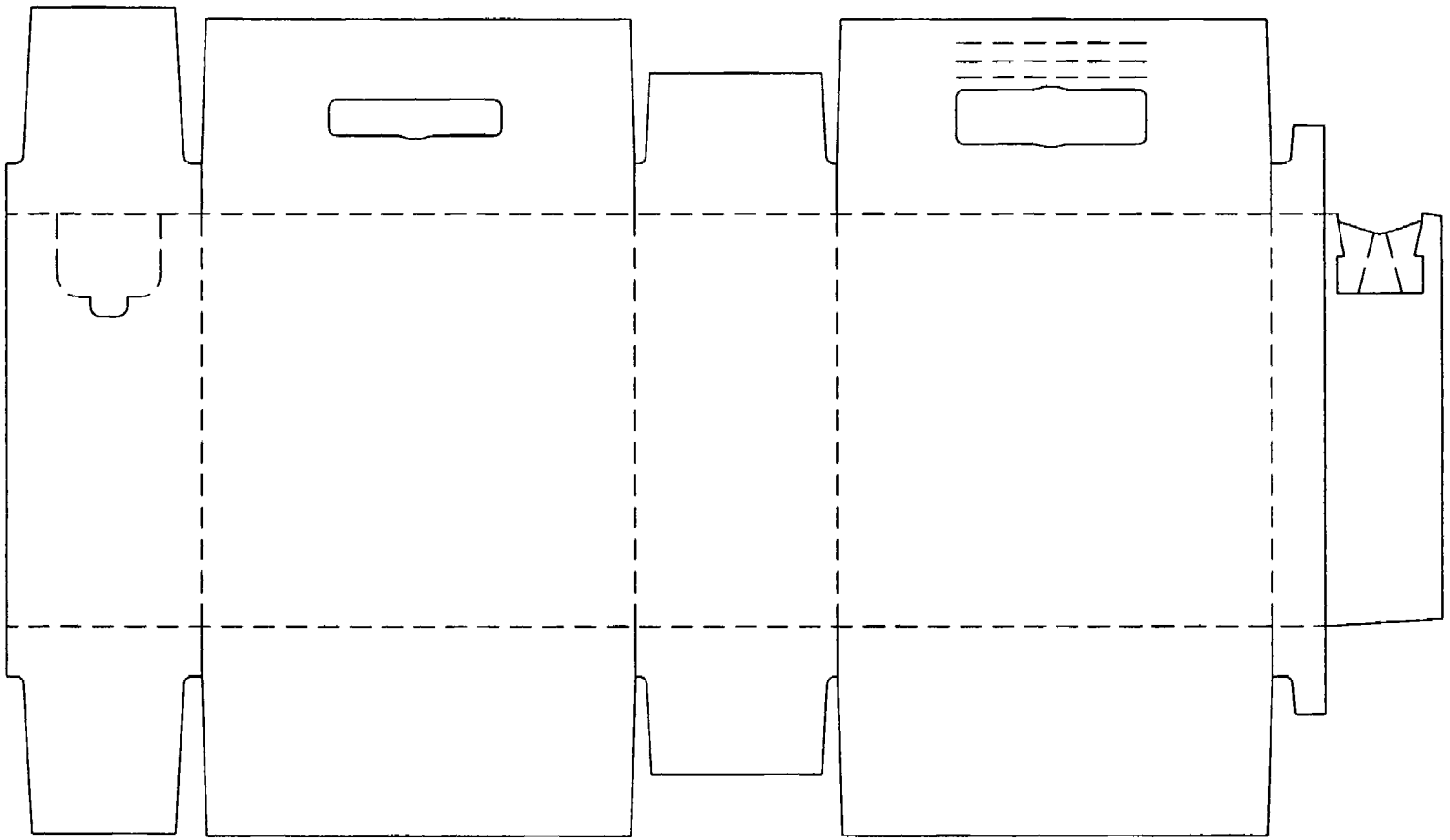
FIG. 1 (Prior Art)
FIG. 1 is a schematic plan view of a prior art container blank incorporating a conventional pour spout.
Figure 2:
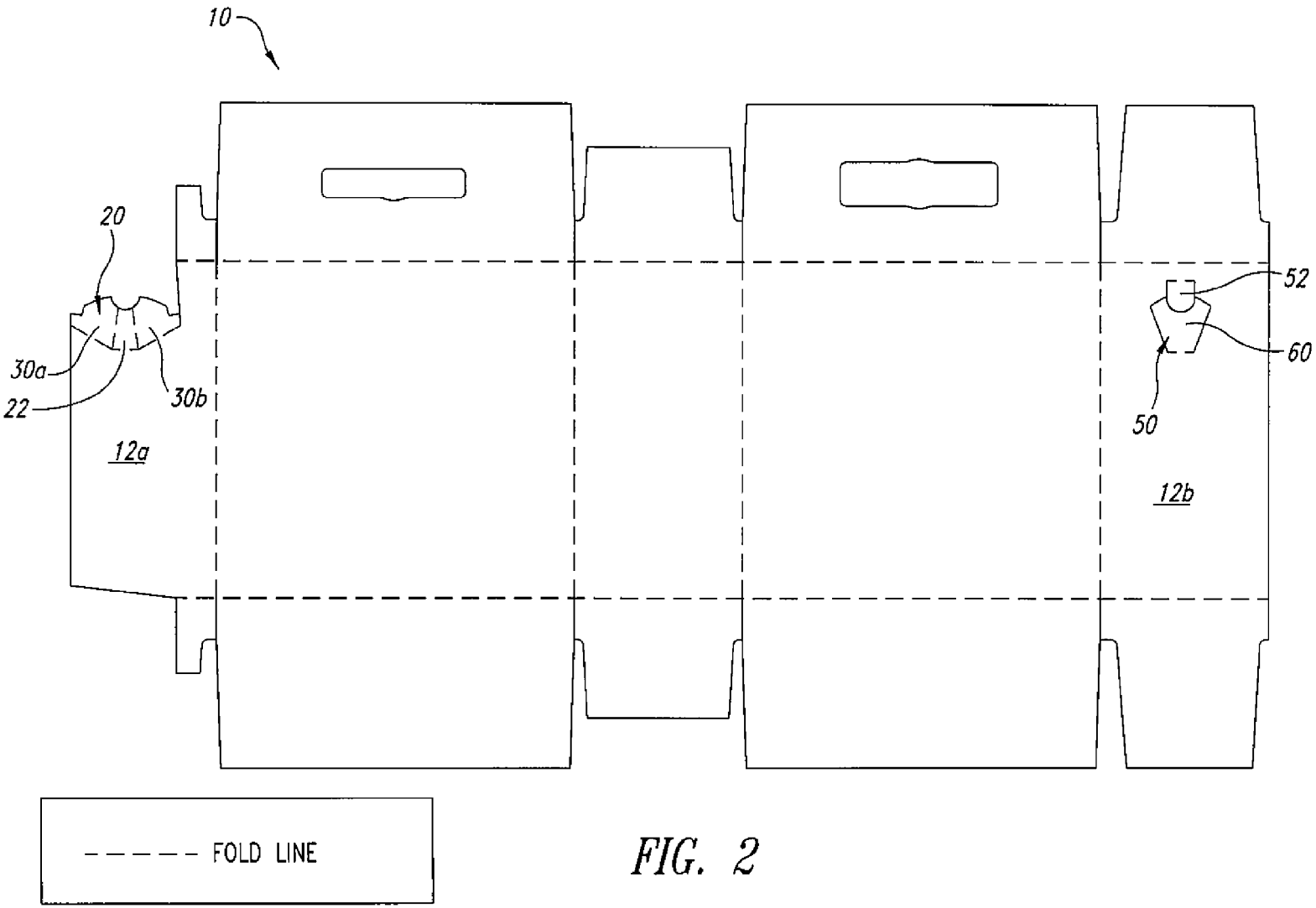
FIG. 2 is a schematic plan view of a container blank incorporating a first embodiment of the invention.
Figure 5:
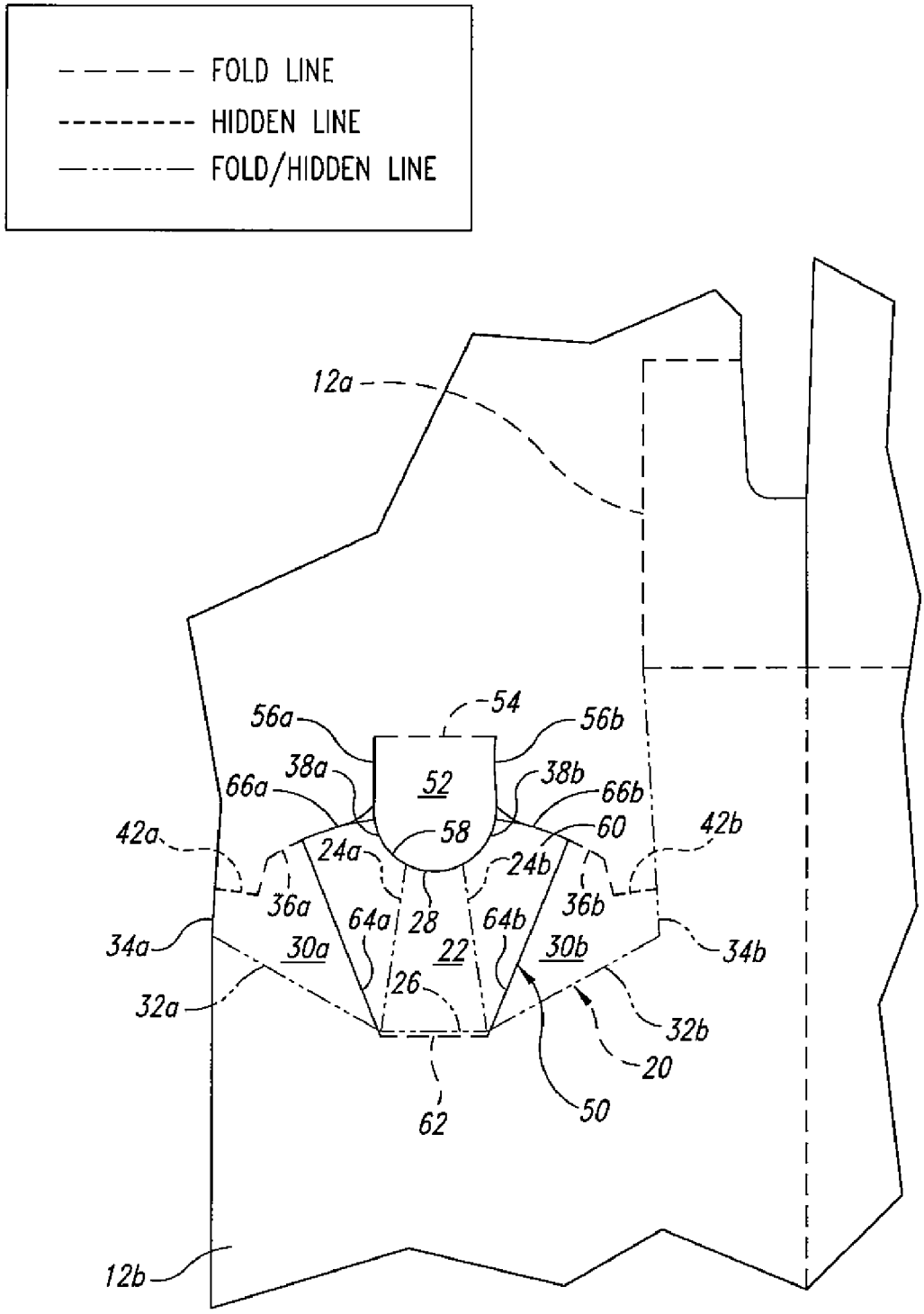
FIG. 5 is a registered composite overlay of FIGS. 3 and 4 wherein the relative relationship between the spout portion and the pull tab portion of the first embodiment is shown.

Turning then to the several Figures wherein like numerals indicate like parts, and more particularly to FIG. 2, a plan view of a corrugated container blank incorporating an embodiment of the invention is shown. Container blank 10 is preferably constructed from 40 pound basis corrugated material having a "B" flute size, and has general dimensions of 22" by 39", with the corrugation running in the vertical direction. End panel 12*a* defines spout 20 while end panel 12*b* defines orifice 50, which when container blank 10 is formed into a container 10' such as shown in FIG. 5, is non-permanently occluded by tab "A" 52 and tab "B" 60.

In FIG. 3, which is a detailed view of spout 20, the elements thereof will now be described. Spout 20 comprises central portion 22, and lateral wings 30*a* and 30*b*. To permit the required deflection of wings 30*a* and 30*b*, lateral hinge segments 24*a* and 24*b* are provided at the interface between central portion 22 and wings 30*a/b*, and comprise a plurality of perforations formed in the container blank. Those persons skilled in the art will appreciate that the use of perforations may not be necessary in all instances; if wings 30*a* and 30*b* are constructed from a sufficiently pliable or resilient material, there may not be a need to localize the stress in order to achieve deflection of the wings. However, since the illustrated embodiment is constructed from corrugated paperboard and the axis of pivot is askew to the direction of corrugation, perforations are considered desirable.

Spout 20 is hingedly linked to panel 12*a* at lower hinge segment 26, which is also characterized as comprising a plurality of perforations. Again, the use of perforations to enhance the functionality of the described embodiment is considered desirable in view of the materials used, however, their presence is not required depending upon material selection and spout geometry. Alternatives to perforation include scoring.

Each wing 30*a/b* further includes lower edge segment 32*a/b*, lateral edge segment 34*a/b*, stop edge segment 44*a/b*, upper edge segment 36*a/b* and recess edge segment 38*a/b*, respectively. Each wing also comprises an over-extension prevention feature in the form of notch 42*a/b*, which comprises stop edge segment 44*a/b* and cut-back edge segment 46*a/b*. As will be described below, the over-extension prevention feature prevents unintended extension of spout 20 from orifice 50 defined by panel 12*b*. Recess edge segments 38*a/b* of wings 30*a/b* and recess edge segment 28 of central portion 22 may be formed to accommodate the intrusion of tab "A" 52 as will be described below.

Figure 10:
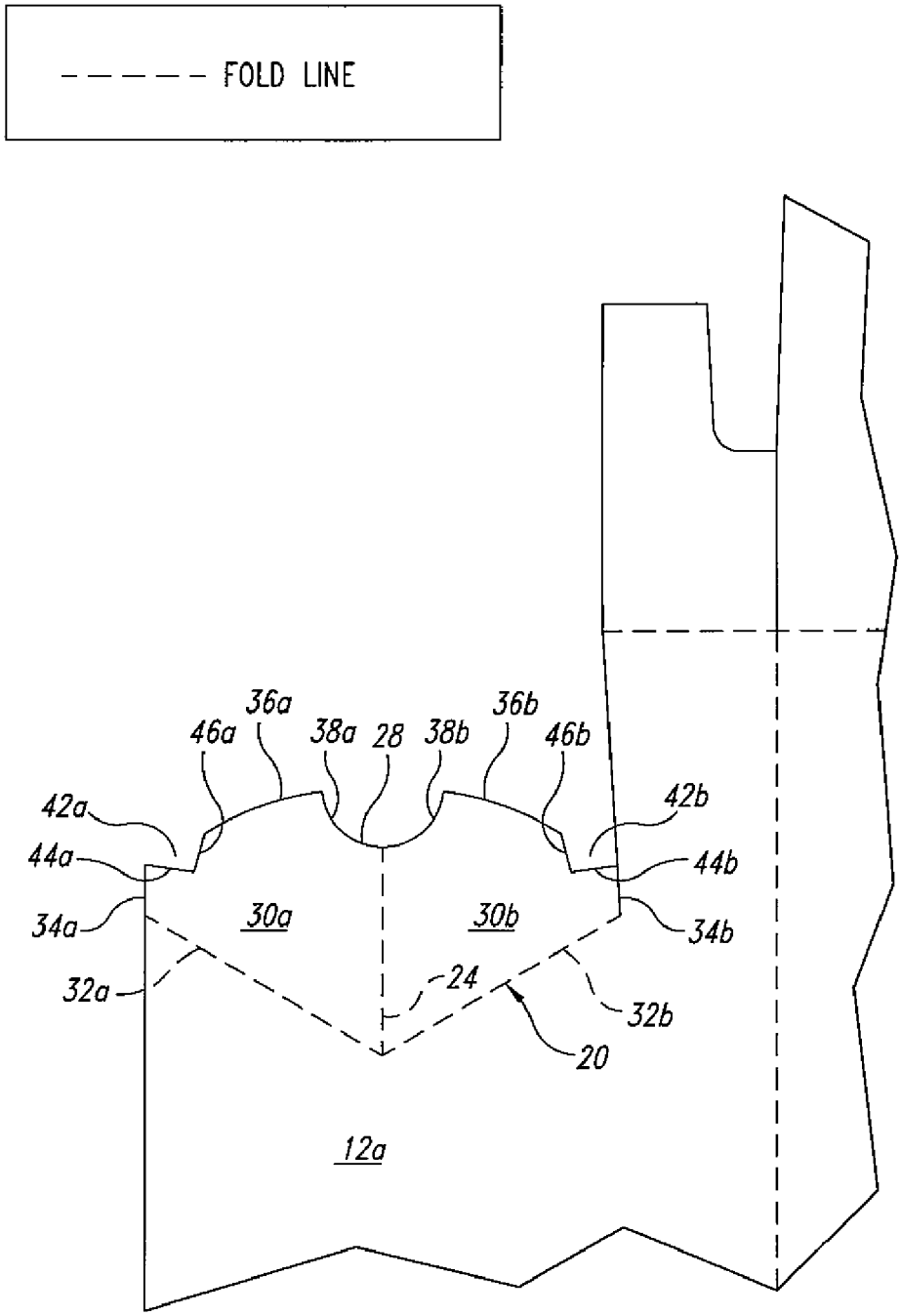
FIG. 10 is a partial front elevational view of a spout provided in accordance with an alternative embodiment of the invention.

In an alternate embodiment of the present invention as illustrated in FIG. 10, wings 30*a/b* may be joined directly by a singular hinge segment 24, thereby obviating the need for a central portion. In this embodiment, wings 30*a/b* may be hingedly connected to the inner panel at least at a portion of wing lower segments 32*a/b*, about which the spout may rotate into the extended position. In this embodiment of the present invention, when the spout is extended, wings 30*a/b* interact with the orifice to form a "V" geometry hinged at hinge segment 24. Although such a configuration still permits use of the invention, the volume of dispensed solids will be reduced and clogging of the spout may increase depending upon the shape and size of the dispensed solids. Through incorporation of a central portion with moderately inclined wings, the size of the dispensing orifice can be maximized.

Figure 4:
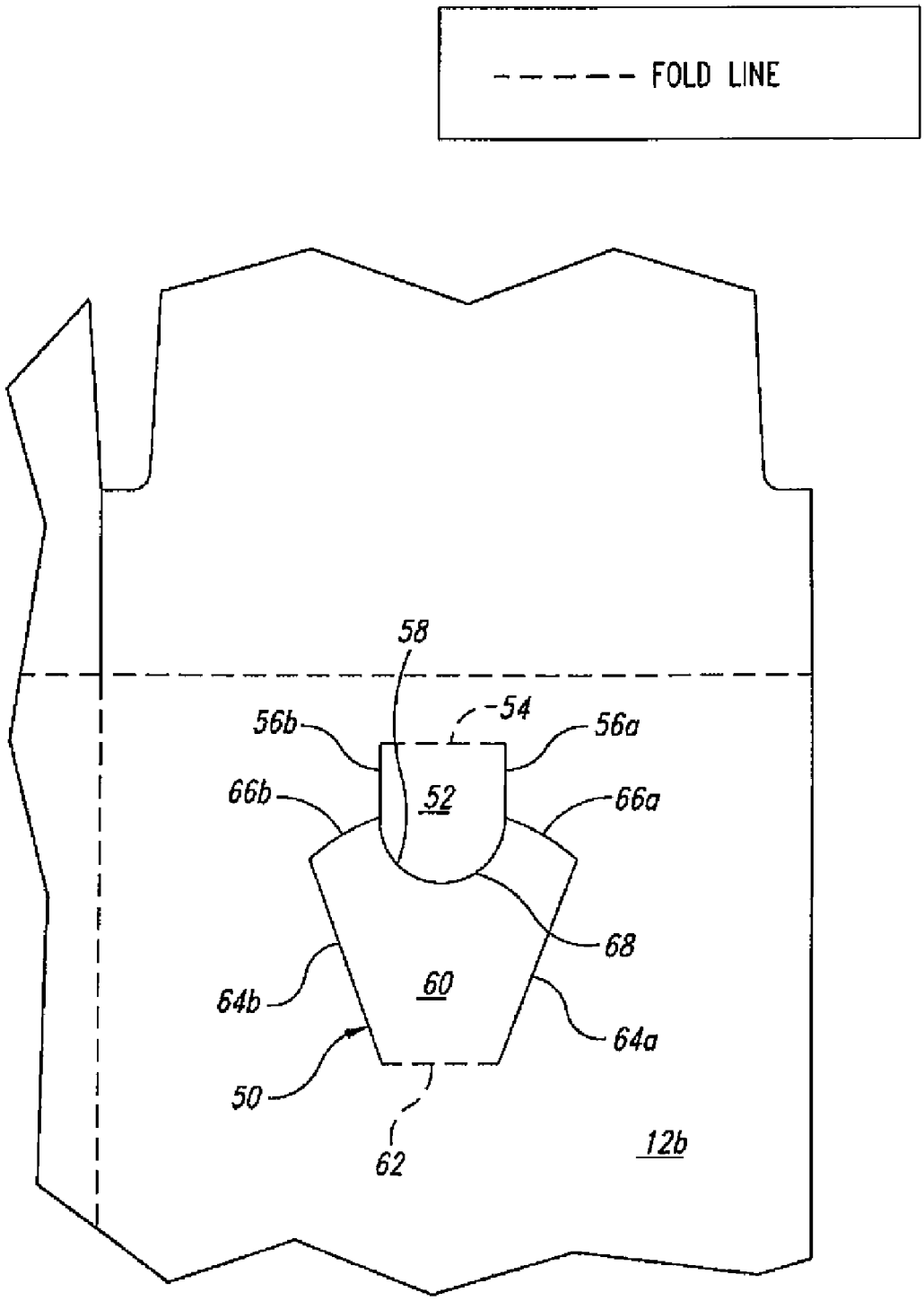
FIG. 4 is an enlarged view of the pull tab portion of the first embodiment shown in FIG. 2.

Panel 12*b* defines orifice 50 as shown in FIG. 4 and as previously described. While only orifice 50 is desirable for operation of spout 20, the illustrated embodiment includes occluding tab "A" 52 and tab "B" 60, which have been perforated for consumer breach in order to access spout 20 after purchase of the container comprising the embodiment. For convenience, reference to an "edge" applies to both the tab edge and the orifice edge, since they are common to one another.

Turning then to tab "B" 60, it has lower hinge segment 62, which is characterized as comprising a plurality of perforations to permit hinged movement of tab "B" 60. Tab "B" 60 also includes lower lateral perimeter edge segments 64*a/b* and upper lateral perimeter edge segments 66*a/b*. In addition, it has common perimeter 68, which corresponds to common perimeter 58 of tab "A" 52. In turn, tab "A" 52 has lateral perimeter edge segments 56*a/b* as well as upper hinge segment 54, which is characterized as comprising a plurality of perforations to permit hinged movement of tab "A" 52. With respect to all tab edge segments (this does not apply to perforated hinge segments), it is understood that the perforations are such that a consumer may easily breach the frangible connection created thereby to cause either tab "A" 52 or tab "B" 60 to pivot about its respective hinge.

Turning to FIGS. 5 through 9, operation of the invention will now be described. As shown best in FIG. 5, when panel 12*b* is overlapped and bonded to panel 12*a* (note that no portion of spout 20 or orifice 50 is bonded), the resulting alignment creates a symmetrical overlay of spout 20 and orifice 50 about an imaginary vertical centerline. In addition, lower hinge segment 26 of spout 20 is generally superposed over lower hinge segment 62 of tab "B" 60 (note that slight displacement of lower hinge segment 26 relative to lower hinge segment 62 is permissible and accounts for reduced interference; as used herein, "generally superposed" includes this relationship). In addition, both wings 30*a* and 30*b* extend beyond lower lateral perimeter edge segments 64*a* and 64*b*, respectively.

When a consumer of the contents of container 10' desires to access the contents, sufficient inward pressure is applied to tab "A" 52 so as to cause lateral perimeter edge segments 56*a/b*, and common perimeter 58 to fail. Because inward pivoting of tab "A" 52 is unrestricted by spout 20 (recall that spout 20 includes recess segments 28 and 38*a/b*), both tab "B" 60 and spout 20 are now accessible and extendable by the consumer.

Figure 6:
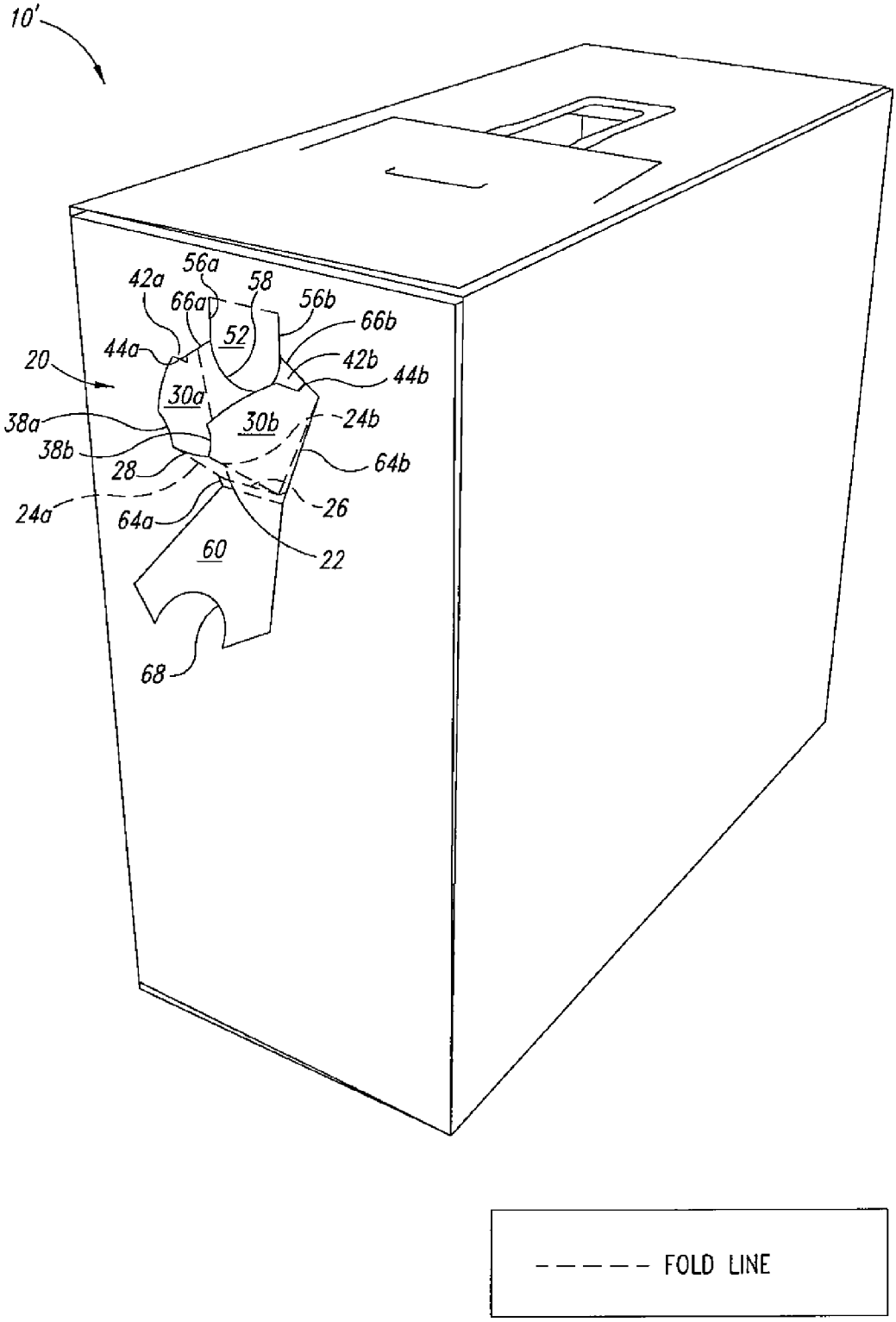
FIG. 6 is a perspective view of a container incorporating the first embodiment of the invention after extension of the spout portion.
Figure 7:
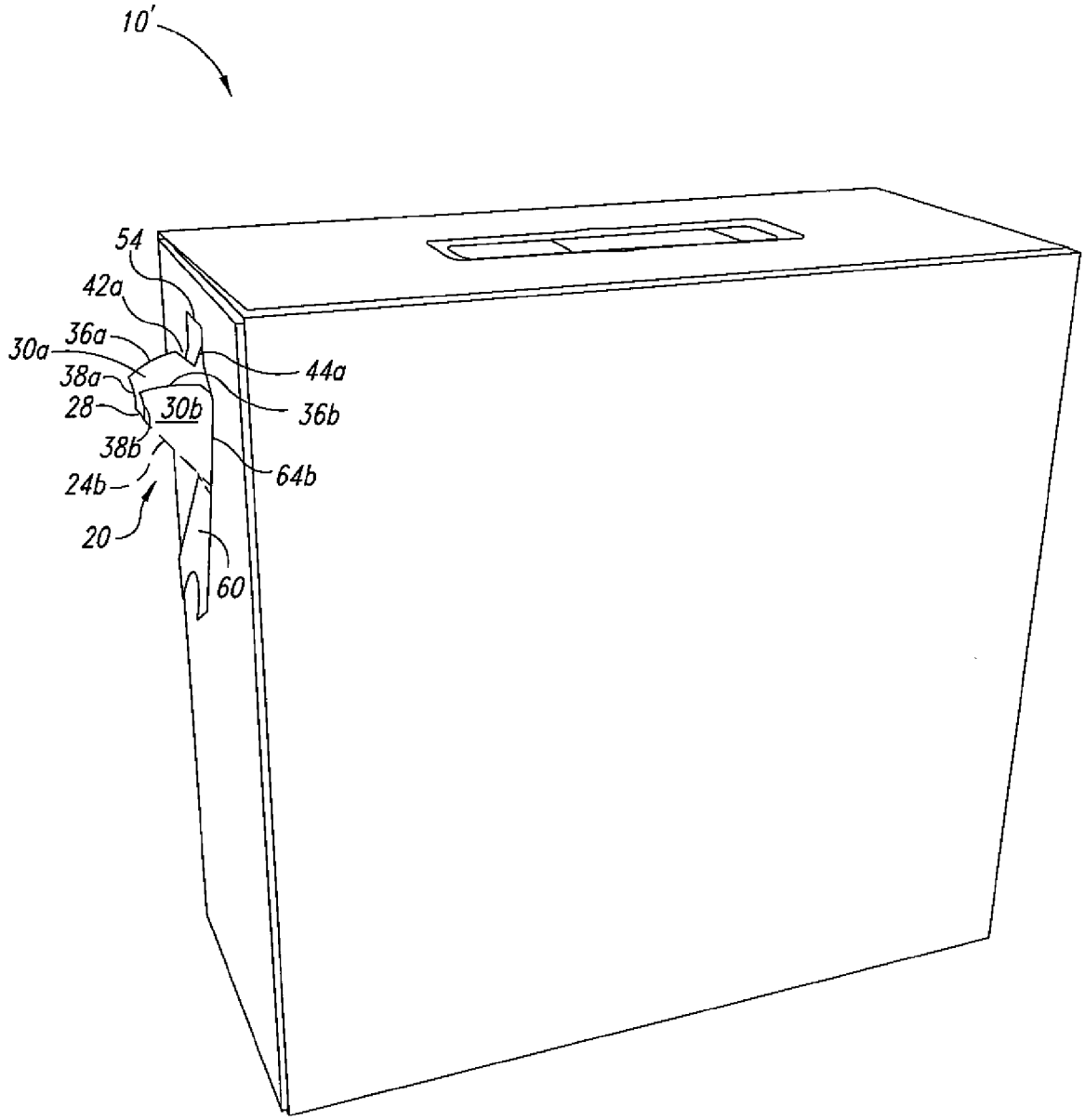
FIG. 7 is a side elevational view in perspective of the container of FIG. 6 incorporating the first embodiment of the invention after extension of the spout portion.
Figure 8:
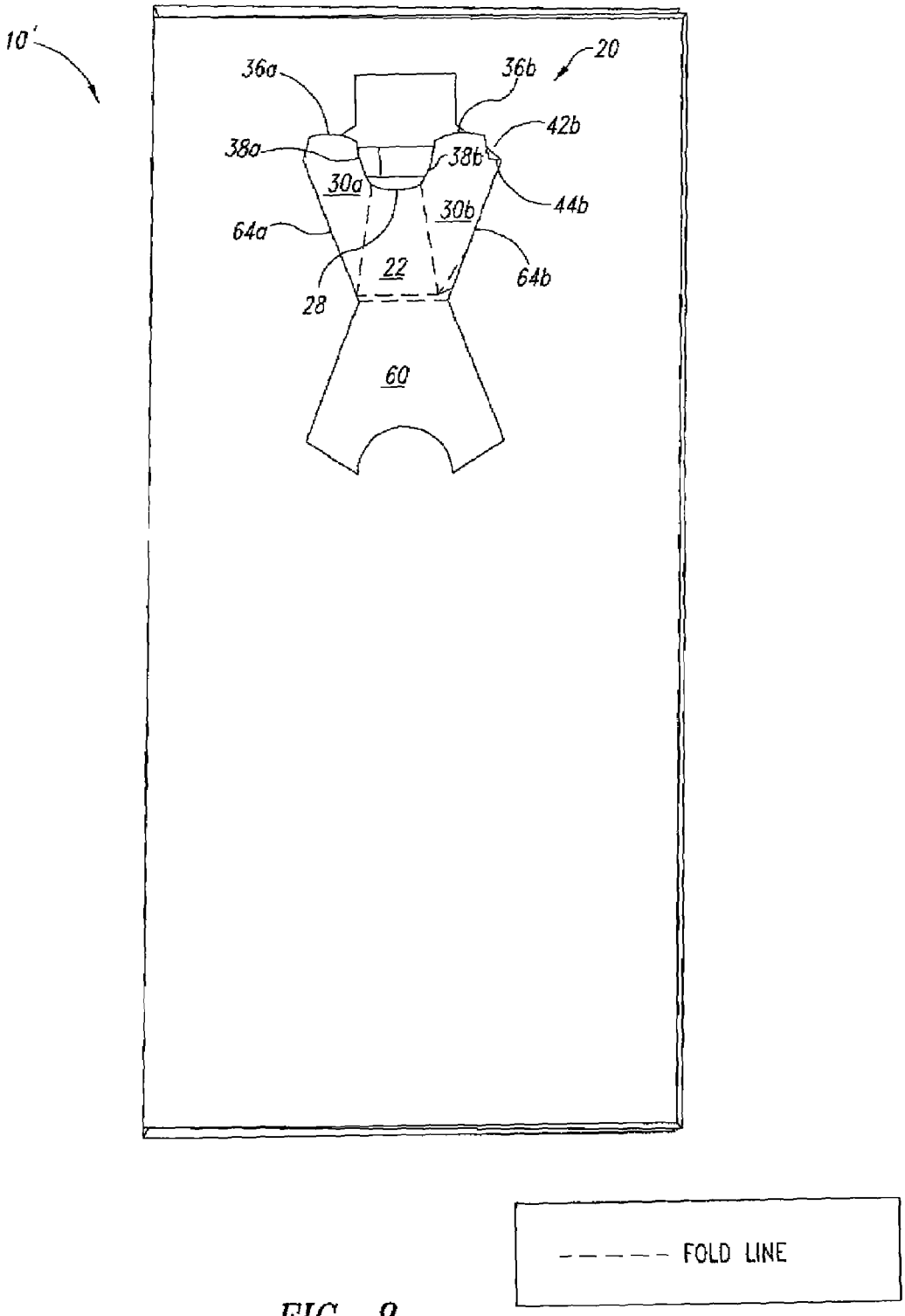
FIG. 8 is a front elevational view of the container of FIG. 6 incorporating the first embodiment of the invention after extension of the pull tab portion and the spout portion.

FIG. 6 is a perspective view of a container 10' according to one embodiment of the present invention after extension of the spout portion. As illustrated in FIG. 6, the consumer will pull at common perimeter 68 of tab "B" 60 and recess edge segment 28 of central portion 22, causing failure of lower lateral perimeter edge segments 64*a/b* and upper lateral perimeter edge segments 66*a/b*, resulting in the outward pivoting of tab "B" 60. In addition, spout 20 will pivot about lower hinge segment 26, causing inward pivoting of wings 30*a/b* about their respective lateral hinge segments 24*a/b*. As outward pivoting of spout 20 continues, wings 30*a/b* continue to ride against lower lateral perimeter edge segments 64*a/b* until notches 42*a/b*, and particularly stop edge segments 44*a/b*, engage upper lateral perimeter edge segments 66*a/b*, respectively. FIG. 7 is a side elevational view in perspective of the container of FIG. 6 after extension of the spout portion. As illustrated in FIG. 7, further outward pivoting of spout 20 is arrested, while beneficially retaining the proximate arrangement between wings 30*a/b*, and respective lower lateral perimeter edge segments 64*a/b*. FIG. 8 is a front elevational view of the container of FIG. 6 after extension of the pull tab portion and the spout portion. As illustrated in FIG. 8, when the spout 20 is extended, the recess edges 38*a/b* of the two opposing wings and the recess edge 28 of the central portion are formed to guide the container contents toward the recess edge 28 of the central portion and prevent the contents from bypassing the spout when poured.

Figure 9:
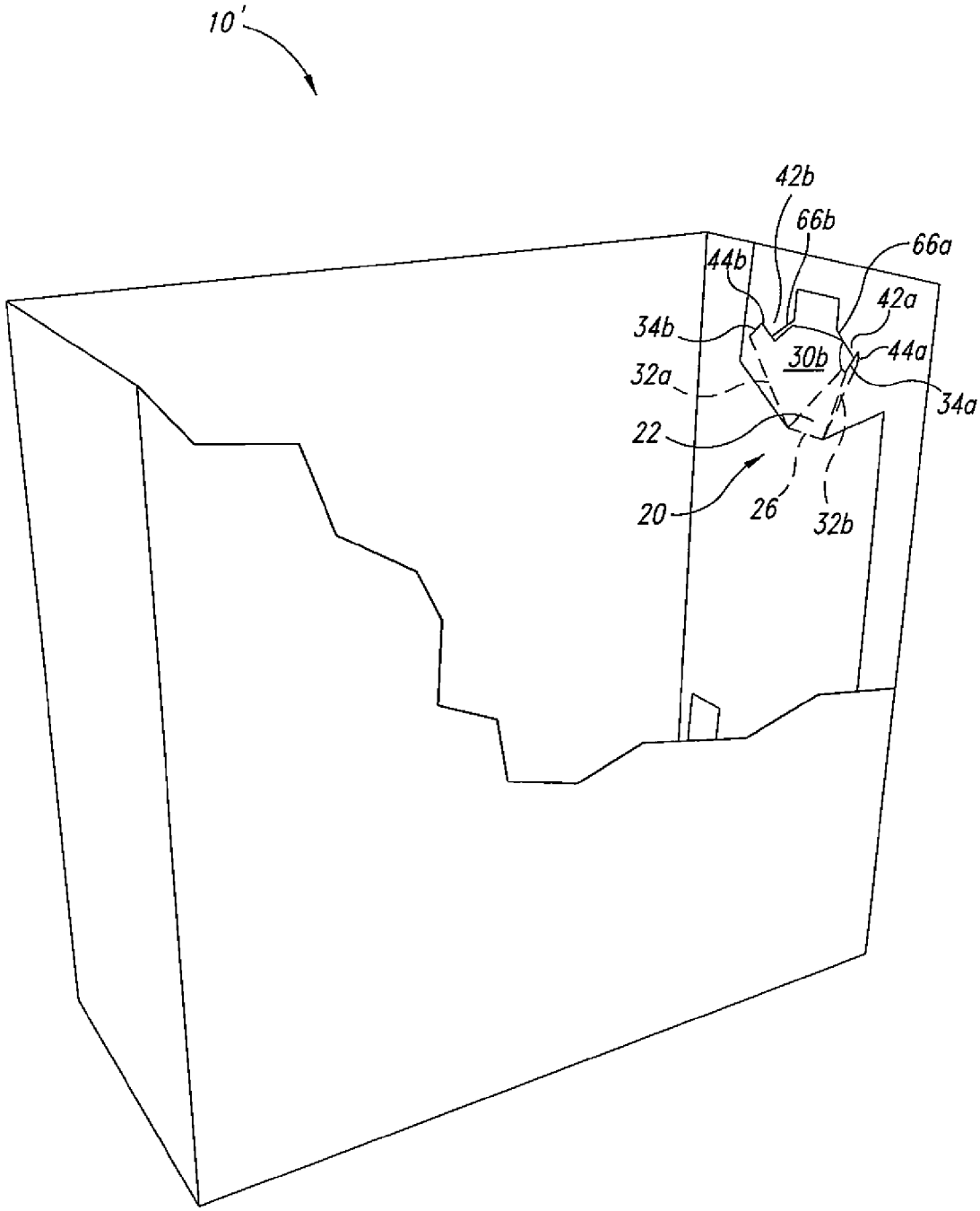
FIG. 9 is a perspective view with cut-out to reveal the interior of the container of FIG. 6 illustrating the engagement of an overextension feature with the container.

FIG. 9 is a perspective view with cut-out to reveal the interior of the container of FIG. 6 in order to further illustrate the engagement of an overextension feature with the container. FIG. 9 shows a view from the interior of the container, depicting the interference between notches 42*a/b* and upper lateral perimeter edge segments 66*a/b* at stop edge segments 44*a/b* to prevent overrotation of the spout 20. In addition, because only outward pivotal motion is arrested by notches 42*a/b*, when the consumer is finished with dispensing the contents of the container, spout 20 may be pivoted inwardly, thereby minimizing external interference due to an extended spout and generally restricting unintentional escapement of the container contents.

All of the above U.S. patents, U.S. patent application publications, U.S. patent applications, foreign patents, foreign patent applications and non-patent publications referred to in this specification and/or listed in the Application Data Sheet, are incorporated herein by reference, in their entirety.

From the foregoing it will be appreciated that, although specific embodiments of the invention have been described herein for purposes of illustration, various modifications may be made without deviating from the spirit and scope of the invention. Accordingly, the invention is not limited except as by the appended claims.

I claim:

1. A container for storing and dispensing a content of the container, comprising:

an outer panel;

an inner panel contiguous to and formed from a unitary body of material with the outer panel;

a spout formed from a planar portion of the inner panel and comprising a lower side hingedly connected to the inner panel allowing the spout to pivot between a first closed position and a second extended position, a center panel laterally interposed between first and second wing panels, the center panel having an upper side forming a dispensing portion of the spout and comprising a concavity along at least a portion thereof, and two opposing lateral sides forming hinged connections with the first and second wing panels, respectively, an inner surface of each wing panel forming an obtuse angle with an inner surface of the center panel and an acute angle with the inner panel when the spout is in the second position;

a first tab formed in the outer panel detachable around at least a portion of a periphery thereof and sized to at least partially detach in response to a force exerted by a finger of a user, the first tab having an upper side hingedly connected to the outer panel allowing the first tab to pivot between a first closed position and a second open position when partially detached and a curvilinear lower side configured to cover the concavity of the upper side of the center panel of the spout when the first tab is in the first position and provide access to the spout when in the second position; and a second tab formed in the outer panel detachable around at least a portion of a periphery thereof and positioned contiguous a portion of the spout when the spout is in the first position, the second tab having a lower side hingedly connected to the outer panel allowing the second tab to pivot between a first closed position and a second open position, an orifice being formed in the outer panel when the second tab is in the second position, a maximum width of the spout exceeding a maximum width of the orifice.

2. The container according to claim 1, wherein a lateral centerline of the orifice is aligned with a lateral centerline of the spout.

3. The container according to claim 1 further comprising:

a notch provided in a perimeter of the spout, the notch being positionable to engage a perimeter of the orifice as the spout is pivoted through the orifice, to prevent overrotation of the spout.

4. A method for forming a spout on a container, the container and the spout being formed from a unitary body of material and the container comprising an inner panel and an outer panel, the method comprising:

breaching a first portion of the outer panel to form a first tab detachable around a periphery thereof, the detachable periphery of the first tab having a curvilinear lower side interposed between first and second lateral sides extending up and terminating at first and second laterally spaced terminal ends, and forming a first fold line on the outer panel extending between the first and second terminal ends of the detachable periphery of the first tab to form a hinged upper side, allowing the first tab to pivot between a first closed position and a second open position, the first tab being sized to at least partially detach in response a force exerted by a finger of a user;

breaching a second portion of the outer panel to form a second tab detachable around a periphery thereof and having first arid second lateral boundaries longitudinally converging toward a lower end of the container with respect to the spout and terminating at first and second laterally spaced terminal ends, the lateral centerline of the second tab being aligned with the lateral centerline of the first tab, and forming a second fold line on the outer panel extending between the first and second terminal ends of the detachable periphery of the second tab to form a hinged lower side, allowing the second tab to pivot between a first closed position and a second open position;

forming a first fold line on a portion of the inner panel to form a lower hinged segment of the spout interposed between first and second lateral edge hinged segments of the spout, the lateral edge segments diverging toward the upper end of the container and terminating at lateral boundaries of the spout, the lower hinged segment being positioned adjacent the hinged lower side of the second tab;

forming a detached upper boundary of the spout from a portion of a detached upper boundary of the inner panel, a central portion of the detached upper boundary being adjacent the upper side of the second tab and having a concavity having a lateral centerline substantially aligned with a lateral centerline of the spout; and forming at least second and third fold lines respectively originating from respective points on the concavity on opposing sides of the lateral centerline and converging to terminate at lateral terminal ends of the lower hinged segment of the spout, such that pivoting the first tab to the second position and exerting a force on a portion of the spout extends the spout and detaching the detachable periphery of the second tab forms an orifice in the outer panel, first and second lateral boundaries of the orifice inducing a folding of the first, second and third fold lines and the spout forming as the spout extends through the orifice.

5. The method according to claim 4 further comprising;

forming first and second notches toward first and second lateral ends of the detached upper boundary of the spout, the first and second notches configured to engage the first and second lateral boundaries of the orifice to prevent overrotation of the spout.

6. A container blank adapted to form a container having a spout formed from a unitary body of material with the container, the container blank comprising:

a first panel forming an outer panel of the container when the container is formed;

a second panel formed from a unitary body of material with the first panel and forming an inner panel of the container positioned contiguous the outer panel when the container is formed;

a spout flat pattern formed from a planar portion of the second panel and comprising a lower side hingedly connected to the second panel allowing the spout to pivot between a first closed position and a second extended position, a center panel laterally interposed between first and second wing panels, the center panel having an upper side forming a dispensing portion of the spout and comprising a concavity along at least a portion thereof, and two opposing lateral sides forming hinged connections with the first and second wing panels, respectively, an inner surface of each wing panel forming an obtuse angle with an inner surface of the center panel and an acute angle with the second panel when the container is formed and the spout is in the second position;

a first tab formed in the first panel detachable around at least a portion of a periphery thereof and sized to at least partially detach in response to a force exerted by a finger of a user, the first tab having an upper side hingedly connected to the first panel allowing the first tab to pivot between a first closed position and a second open position when partially detached and a curvilinear lower side configured to cover the concavity of the upper side of the center panel of the spout when the container is formed and the first tab is in the first position and to provide access to the spout when the container is formed and the first tab is in the second position; and a second tab formed in the first panel detachable around at least a portion of a periphery thereof and positioned contiguous a portion of the spout when the spout is in the first position, the second tab having a lower side hingedly connected to the first panel allowing the second tab to pivot between a first closed position and a second open position, an orifice being formed in the first panel when the second tab is in the second position, a maximum width of the spout exceeding a maximum width of the orifice.

7. The container blank according to claim 6, further comprising:

a notch provided in a perimeter of the spout, the notch being positionable to engage a perimeter of the orifice as the spout is pivoted through the orifice, to prevent overrotation of the spout, when the container is formed and the spout is extended.

* * * * *

UNITED STATES PATENT AND TRADEMARK OFFICE

CERTIFICATE OF CORRECTION

PATENT NO. : 7,156,287 B2
APPLICATION NO. : 10/924529
DATED : January 2, 2007
INVENTOR(S) : John Heise It is certified that error appears in the above-identified patent and that said Letters Patent is hereby corrected as shown below:

Column 6
Line 41, "arid" should read as -- and --

Signed and Sealed this

Twenty-ninth Day of April, 2008

JON W. DUDAS
*Director of the United States Patent and Trademark Office*